US006182715B1

(12) United States Patent
Ziegler et al.

(10) Patent No.: US 6,182,715 B1
(45) Date of Patent: Feb. 6, 2001

(54) LIQUID NITROGEN INJECTION SYSTEM WITH FLEXIBLE DOSING ARM FOR PRESSURIZATION AND INERTING CONTAINERS ON PRODUCTION LINES

(76) Inventors: Alex R. Ziegler, 16200 Brooke Acres Dr., Los Gatos, CA (US) 95032; Alan T. Ziegler, 345 Washington St., Santa Cruz, CA (US) 95060

( * ) Notice: Under 35 U.S.C. 154(b), the term of this patent shall be extended for 0 days.

(21) Appl. No.: 09/487,367

(22) Filed: Jan. 18, 2000

(51) Int. Cl.[7] ..... B65B 31/00

(52) U.S. Cl. ..... 141/63; 141/64; 141/82; 141/285; 141/302; 505/897; 62/50.1; 62/50.2; 62/50.4; 53/111 R; 53/431; 222/146.6

(58) Field of Search ..... 141/63, 64, 67, 141/82, 94, 114, 129, 192, 198, 285, 301, 302, 309; 62/48.1, 50.1, 50.2, 50.4, 50.7; 505/888, 897; 53/431, 111 R; 222/146.6

(56) References Cited

U.S. PATENT DOCUMENTS

| | | | | |
|---|---|---|---|---|
| 4,407,340 | | 10/1983 | Jensen et al. | 141/67 |
| 4,489,767 | | 12/1984 | Yamada | 141/48 |
| 4,546,609 | | 10/1985 | Roullet et al. | 62/49 |
| 4,583,346 | | 4/1986 | Kameda | 53/431 |
| 4,588,000 | * | 5/1986 | Malin et al. | 141/1 |
| 4,612,773 | | 9/1986 | Pelloux-Gervais et al. | 62/50 |
| 4,848,093 | | 7/1989 | Simmonds et al. | 62/49.1 |
| 4,854,128 | | 8/1989 | Zeamer | 62/50.1 |
| 4,865,088 | | 9/1989 | Steams | 141/5 |
| 4,899,546 | | 2/1990 | Eigenbrod | 62/50.2 |
| 4,947,650 | | 8/1990 | Blanton et al. | 62/50.1 |
| 5,169,031 | | 12/1992 | Miller | 222/146.5 |
| 5,193,348 | * | 3/1993 | Schnapper | 62/51.1 |
| 5,353,849 | | 10/1994 | Sutton et al. | 141/44 |
| 5,385,025 | | 1/1995 | Kellet | 62/50.1 |
| 5,400,601 | | 3/1995 | Germain et al. | 62/50.1 |
| 5,533,341 | | 7/1996 | Schvester et al. | 62/50.1 |
| 5,548,963 | * | 8/1996 | Skertic | 62/51.2 |
| 5,685,459 | | 11/1997 | Wardle | 222/146.6 |
| 5,743,096 | | 4/1998 | Blanton et al. | 62/50.1 |
| 6,047,553 | * | 4/2000 | Germain | 62/50.1 |

* cited by examiner

*Primary Examiner*—Timothy L. Maust
(74) *Attorney, Agent, or Firm*—Richard B. Main

(57) ABSTRACT

A liquid-nitrogen injection system comprises a vacuum-insulated reservoir that is held aloft and to one side of a flexible dosing arm. Such reservoir is completely sealed and capped on its top and sides, the vent, feed, return, and supply conduits enter only from the bottom. The feed and return conduits connect to the dosing arm through a long flexible, stainless steel, vacuum-insulating jacket. Such allows an injection nozzle at the end of the dosing arm to be adjusted up and down, in and out, and even tilted relative to both the assembly line and the reservoir. This also means the hydraulic pressure head at the control nozzle can be adjusted in the field. A metering orifice is positioned within the dosing arm such that it is behind the control nozzle valve. A nitrogen gas purging system is connected to provide a freeze-up shielding gas flow from a liquid nitrogen tap in the reservoir.

11 Claims, 11 Drawing Sheets

100
102
104
106
108
110
112
114
116
118
120
122
112,114

LIQUID NITROGEN INJECTION SYSTEM WITH FLEXIBLE DOSING ARM FOR PRESSURIZATION AND INERTING CONTAINERS ON PRODUCTION LINES

BACKGROUND OF THE INVENTION

1. Field of the Invention

The present invention relates generally to liquid cryogen dispensing systems, and more specifically to dosing systems that circulate liquid nitrogen from a reservoir dewar through a flexible dosing arm and injector head and release a metered droplet into a beverage, food or other product containers just before its being sealed.

2. Description of the Prior Art

The walls of metal cans are now made of aluminum and so thin that beverage packagers must depend on artificially elevated internal gas pressures to stiffen and strengthen them. Carbonated beverages do this naturally, but non-carbonated beverages need to have droplets of liquid nitrogen added to them just before the package is sealed These shots of liquid nitrogen turn to gas inside the sealed can and the walls take on added strength to resist crushing. This same requirement of internal pressure has become a requirement for companies packaging food and beverage products in thin wall plastic containers. The added pressure makes the plastic container more rigid and facilitates the process through the labeling machines as well as making the product stackable to greater heights.

A popular approach to designing liquid cryogen dispensing systems has been to position a reservoir of liquid nitrogen directly over a moving canning line and allow drops or streams of liquid nitrogen to fall down into the open can just before sealing.

One of the earliest applications of liquid nitrogen dosing systems for pressurizing containers was developed by Reynolds Metal Company (Richmond, Va) in 1982. U.S. Pat. No. 4,407,340, was issued Oct. 4, 1983, to Eric Jensen, et al., and was assigned to Reynolds. Such describes a machine that can inject predetermined amounts of cold liquefied gas into non-carbonated beverage cans just before they are sealed. Eric Jensen, et al., note that freeze-up in prior art devices due to water vapor entering the system has been a continual problem. So a float valve to maintain a constant liquid gas level in the reservoir and a gaseous shield around the exit nozzle are included in their embodiments.

Shortly thereafter in 1982, Toyo Seikan Kaisha, Ltd. (Japan), developed a similar system. U.S. Pat. No. 4,489,767, issued Dec. 25, 1984, to Morio Yamada and was assigned to Toyo Seikan. Such describes dropping liquefied gases into cans with the aid of a can-proximity sensor. The droplets of liquid nitrogen are released into the cans from a control valve and reservoir directly above. The reservoir atmosphere is allowed to pressurize, and the nitrogen vapors are directed coaxially with the liquid nitrogen droplets in a shield-gas flow to reduce nozzle freeze-up and clogging with ice from normal room humidity. Synthetic resins are also suggested as nozzle materials to help prevent nozzle freezing.

Several years later Thornton Stearns, working for Vacuum Barrier Corporation (Woburn, Mass.), described the sub-cooling of liquid nitrogen in U.S. Pat. No. 4,865,088, issued Sep. 12, 1989. When controlled amounts of liquid nitrogen are added to uncapped containers moving in an assembly line, the immediate flashing to gas when the liquid under slight hydraulic pressure is released to atmosphere pressure is prevented. This is done my making sure the liquid nitrogen is cold enough to stay a liquid at atmospheric pressure given its inherent vapor pressure.

Very recently, Vacuum Barrier Corporation (Woburn, Mass.), as assignee, was granted U.S. Pat. No. 5,743,096, issued Apr. 28, 1998, to Russell Blanton, et al. Such describes a device very similar to a commercial product of Vacuum Barrier Corporation now in widespread use for many years. Although it's hard to see in the Patent illustrations, the apparatus locates the vacuum-insulated liquid-nitrogen reservoir up and away to one side of its dosing injector head. This permits the dosing injector head to be mounted above a beverage canning assembly line. The bulky reservoir is behind the assembly line and is elevated enough to create a modest hydraulic pressure head at the control nozzle in the dosing injector head.

Unfortunately, the reservoir's rigid supply and vent conduits branch off the sides near the top. This arrangement requires clearance space that isn't always available in pre-existing and ever-changing beverage packaging assembly lines. The reservoir is also unfortunately connected to the dosing injector head with a short rigid arm. This rigid arm prevents any adjustment of the hydraulic pressure head at the control nozzle and also prevents the dosing head from fitting into very tight spaces. Tilting of the dosing injector head so that the launching trajectories of the liquid nitrogen streamlets are in the same direction and optimal for high speed assembly lines must be determined before a unit is built. These variations are possible in the commercial products of Vacuum Barrier Corporation, but only as permanent modifications during manufacturing of the system. The design of the injection nozzle in these systems also makes changing metering orifices very difficult. The units must be emptied of large amounts of liquid nitrogen in order to access the metering orifice because it is part of the control valve in the dosing injector head.

Such shortcomings make prior art systems inflexible and requires many different models to be custom built to meet each new and different manufacturing environment. All of which means both the initial cost of acquisition and the cost of using the devices will be higher than is really necessary.

SUMMARY OF THE PRESENT INVENTION

It is therefore an object of the present invention to provide a liquid-nitrogen injection system that can meter controlled amounts of liquid nitrogen into food and beverage cans and bottles just before they are sealed on slow and fast moving production lines.

It is a further object of the present invention to provide a liquid-nitrogen injection system that can fit into extremely tight spaces on fast moving production lines.

It is another object of the present invention to provide a liquid-nitrogen injection system that can adapt easily to changing conditions and applications on food, beverage can and other bottle and container production lines Briefly, a liquid-nitrogen injection system embodiment of the present invention comprises a vacuum-insulated reservoir that is held aloft and to one side of a flexible dosing arm. Such reservoir is completely sealed and capped on its top and sides, the vent, feed, return, and supply conduits enter only from the bottom. The feed and return conduits connect to the dosing arm through a long flexible, stainless steel, vacuum-insulating jacket. Such allows an injection nozzle at the end of the dosing arm to be adjusted up and down, in and out, and even tilted relative to both the assembly line and the reservoir. This also means the hydraulic pressure head at the control nozzle can be adjusted in the field. A metering orifice is positioned within the dosing arm such that it is behind the control nozzle valve. A nitrogen gas purging system is connected to provide a freeze-up shielding gas flow from a liquid nitrogen tap in the reservoir.

An advantage of the present invention is that a liquidnitrogen injection system is provided that will fit into extremely tight spaces along a container production line that were never originally meant to provide space for a liquid nitrogen injection unit.

Another advantage of the present invention is that a liquid-nitrogen injection system is provided that is flexible and adaptable to changing conditions and applications in the field.

A further advantage of the present invention is that a liquid-nitrogen injection system is provided that resists freeze-ups and is easy to maintain.

These and other objects and advantages of the present invention will no doubt become obvious to those of ordinary skill in the art after having read the following detailed description of the preferred embodiment which is illustrated in the drawing figures.

IN THE DRAWINGS

DETAILED DESCRIPTION OF THE PREFERRED EMBODIMENTS

Figures 1A, 1B:
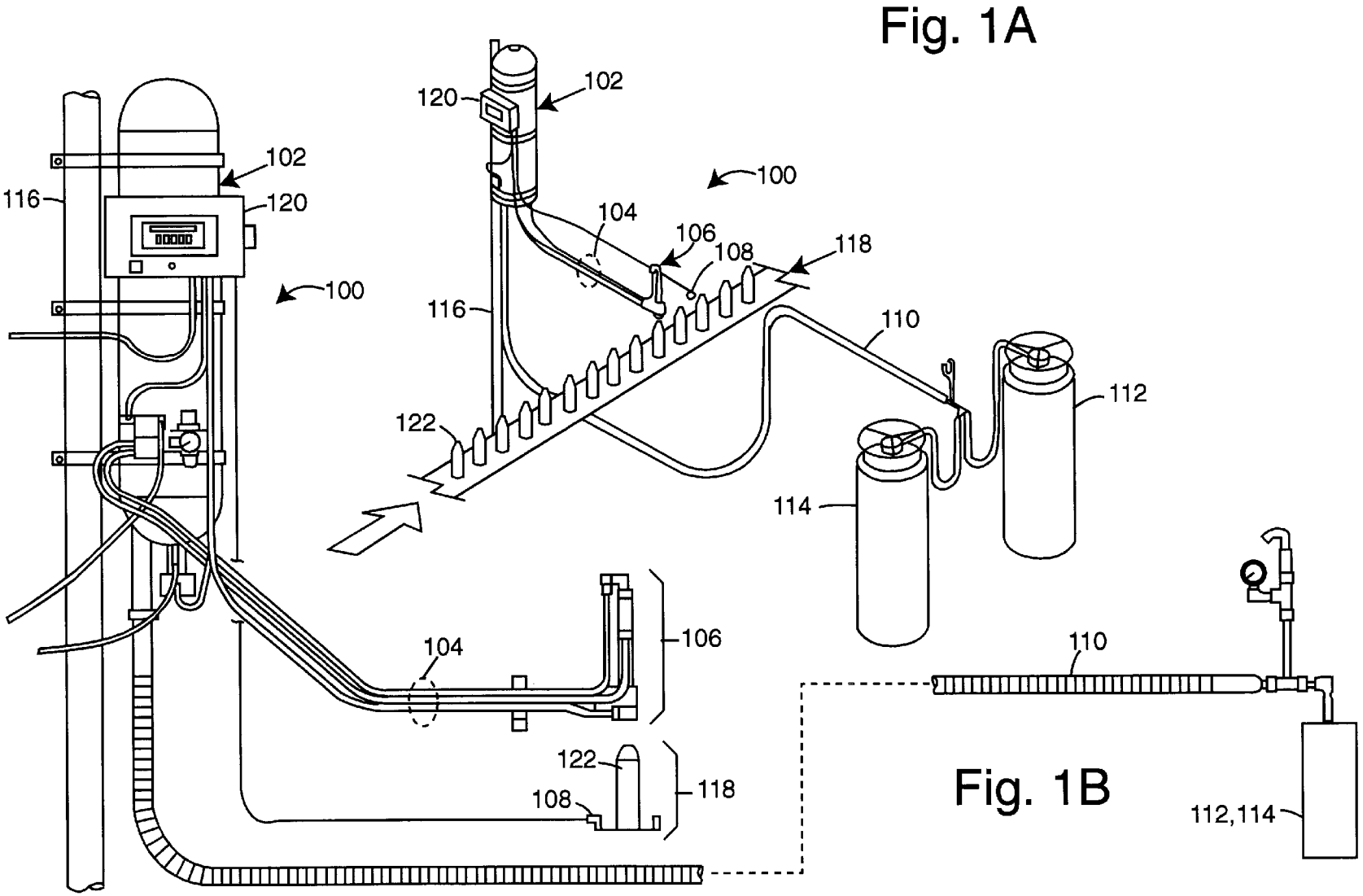
FIGS. 1A and 1B are perspective diagrams of a liquid-nitrogen injection system embodiment of the present invention.
Figure 2:
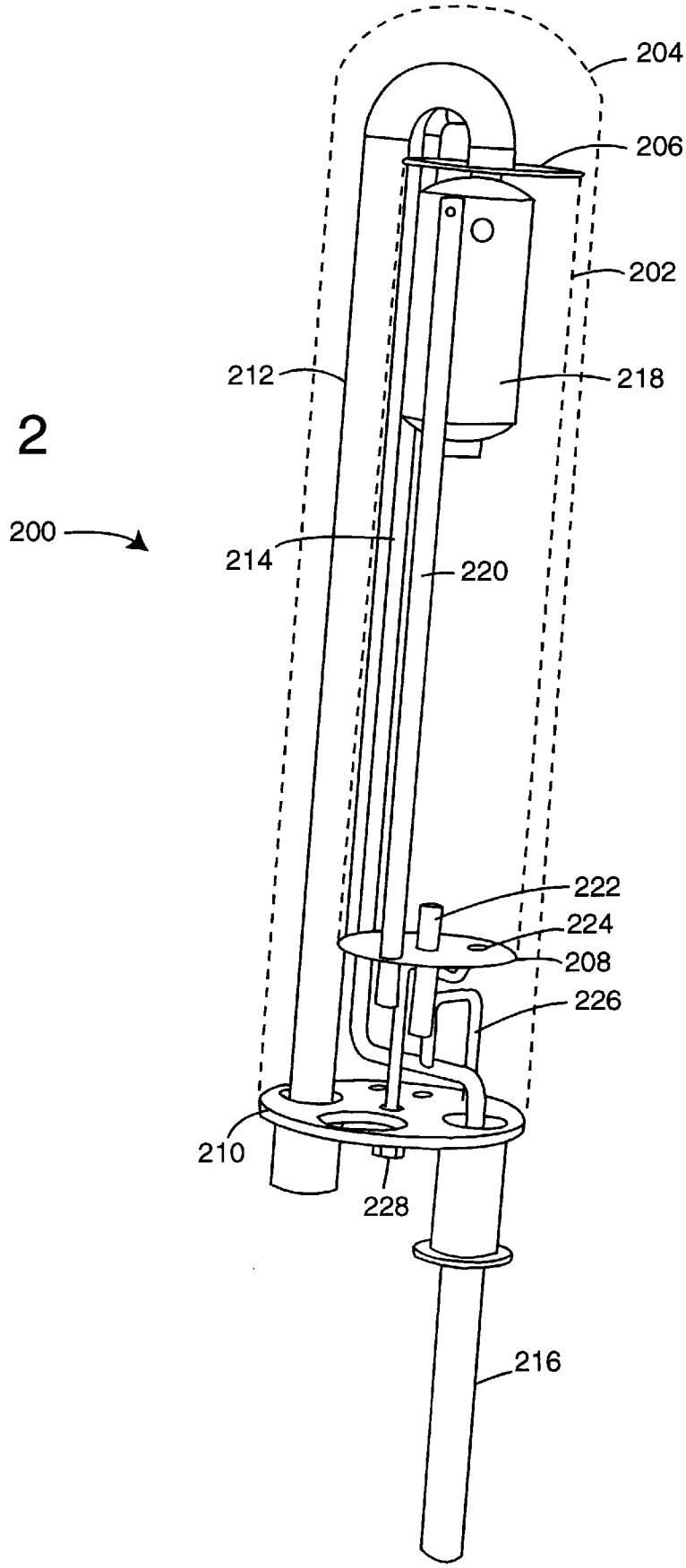
FIG. 2 is a perspective diagram of a liquid nitrogen reservoir embodiment of the present invention.

FIGS. 1A and 1B illustrate a liquid-nitrogen injection system embodiment of the present invention, and is referred to by the general reference numeral 100. The system 100 comprises a vacuum-insulated liquid-nitrogen reservoir 102 that connects through a flexible conduit 104 to a dosing head 106. A sensor 108 is used to detect when the dosing head should squirt out droplets of liquid nitrogen into a can or bottle in an assembly line. A supply conduit 110 connects to standard liquid gas cylinders 112 and 114 filled with liquid nitrogen (LN2). A post 116 supports the reservoir 102 with an attachment that allows some up and down height adjustment. A typical beverage can and bottle assembly line 118 passes at high speed just under the dosing head 106. A control unit 120 uses the sensor 108 to determine when it should operate a control valve in the dosing head 106 and the amount of time said control valve should be open. A typical container 122 is shown immediately before it receives its sealing cap that will contain the expanding gas from the droplets of liquid nitrogen. Such creates a gas pressure within a beverage or food container that increases package crushing pressure and wall strength and/or said droplets of liquid nitrogen will inert the space between the product and the sealing cap to the container FIG. 2 shows the internal details of a liquid nitrogen reservoir assembly 200. Both an internal cylinder wall 202 that contains the liquid nitrogen and its surrounding external cylinder 204 that keeps-in the vacuum insulation are not fully shown so the other pieces can be understood more clearly. A top and bottom disk 206 and 208 cap both the top and bottom ends of the internal cylinder wall 202. The surrounding external cylinder 204 has a closed top end and the bottom is capped-off by a bulkhead 210. Gaseous nitrogen that has evaporated at atmospheric pressure, inside a reservoir formed by the internal cylinder wall 202 and the top and bottom disks 206 and 208, is vented out through a vent tube 212 that passes through top disk 206 and bulkhead 210. A liquid nitrogen supply conduit 214 is routed up through the top disk 206 from the bulkhead 210 and a vacuum-insulated supply conduit 216. This is used to keep the reservoir full of liquid gas. A float 218 controls how full the reservoir can get. A return stack 220 allows a dosing head to recirculate unused nitrogen to the reservoir. A feed outlet 222 supplies the dosing head but is set so that it cannot drain out all the liquid nitrogen inside the reservoir preventing any debris from flowing from the reservoir to the dosing valve. Setting position of feed outlet 222 also keeps a residual supply of liquid at the bottom of the reservoir supplying a nitrogen gas purge to the dosing nozzle area via the gaseous nitrogen purge 228 (described more fully in FIG. 11) keeping it free of freeze up when the system is not in use. However, a drain 224 is included that can be used to empty all the liquid nitrogen inside the reservoir, e.g., for service (also described more fully in FIG. 11). A safety relief valve port 226 for the feed line and the float assembly protects the system from over pressurization. A purge tubulation 228 is connected to the drain 224 to provide a constant source of purging gas to a control nozzle in the dosing head.

In alternative embodiments of the present invention, the feed outlet 222 is fitted with an internal pneumatic control valve that allows the dosing head 106 (FIG. 1) to be serviced. Such control valve is used to shut-off the liquid nitrogen feed through conduit 104 (FIG. 1). Conventional systems do not have such an internal valve and require the entire reservoir to be emptied first. This is further complicated by the rather common lack of a drain outlet in prior art reservoirs forcing the operator to drain the liquid through the dosing valve a slow and cumbersome process as the apparatus is fixed to the production line and not easily moved.

Figure 3:
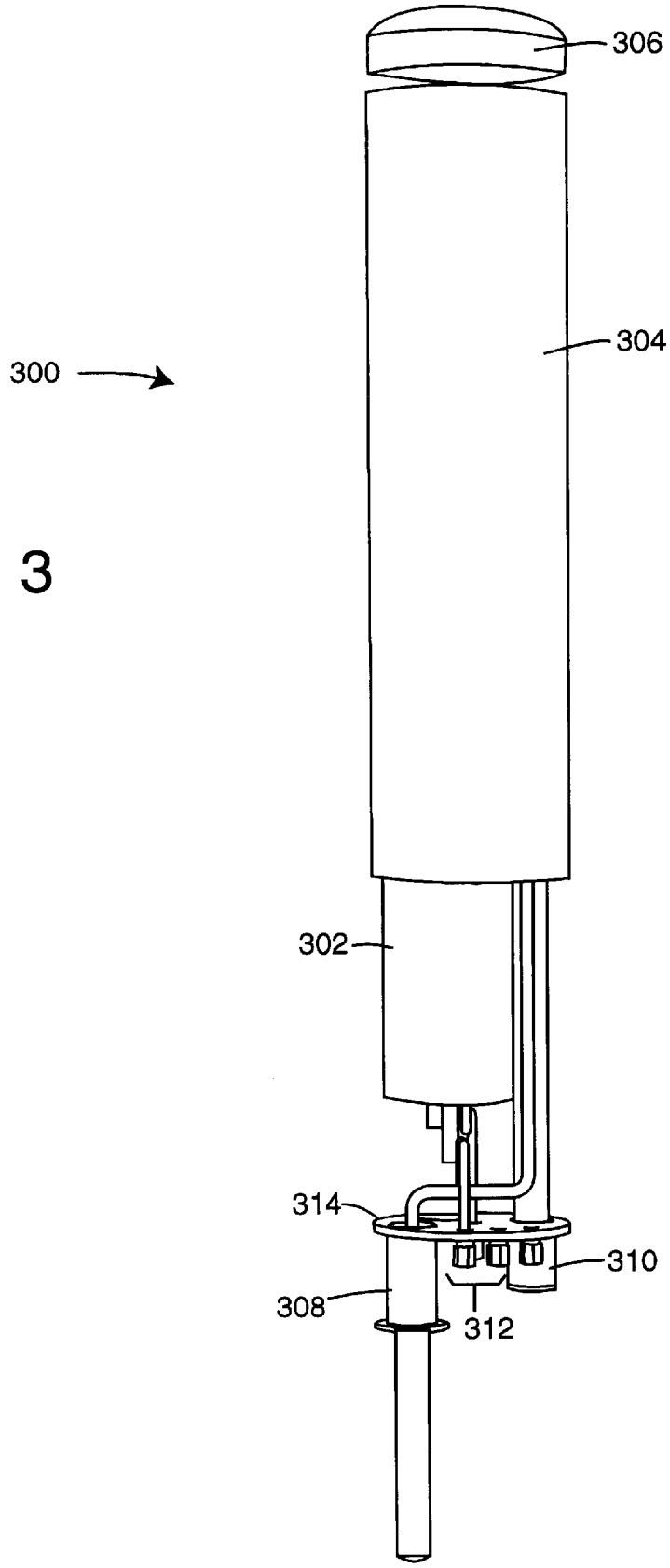
FIG. 3 is a perspective diagram of another liquid nitrogen reservoir embodiment of the present invention, but this view shows the internal and external cylinders used respectively to contain the liquid nitrogen and its vacuum insulation.

FIG. 3 shows a liquid-nitrogen reservoir assembly 300 that is similar to liquid-nitrogen reservoir assemblies 102 (FIG. 1) and 200 (FIG. 2). The liquid-nitrogen reservoir assembly 300 is shown in exploded assembly view with its internal reservoir 302 being sheathed by a vacuum containment cylinder 304 and its end cap 306 A supply conduit 308, a vent conduit 310, and several connection fittings 312 are all mounted to a bottom plate 314. It is critical to the present invention that during use the end cap 306 be oriented up and the bottom plate 314 down. This positioning of the feed and vent openings will inhibit chimney currents that will suck in room air humidity and cause a freeze-up and clogging.

Figure 4:
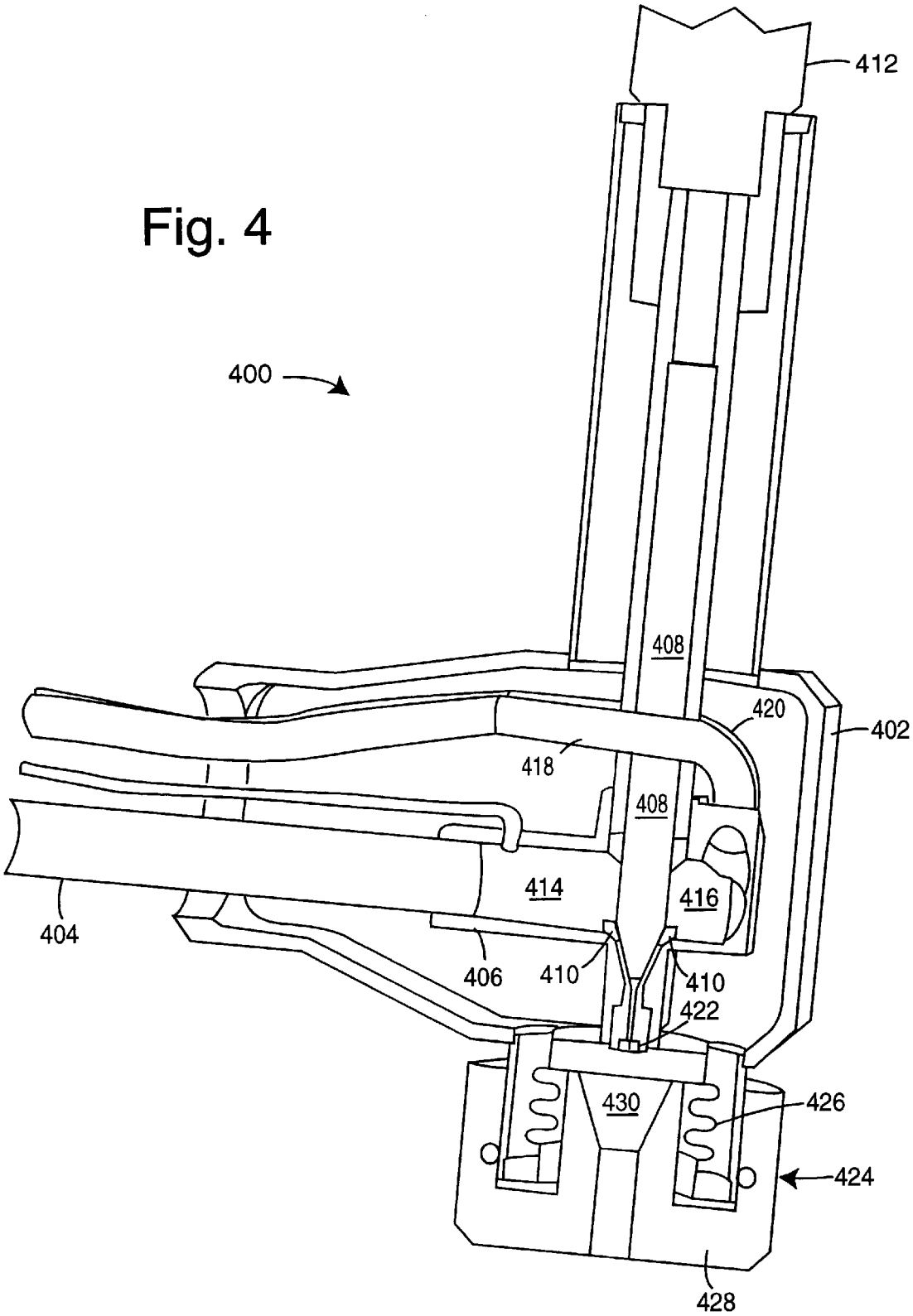
FIG. 4 is a cutaway diagram of a valve body and dosing head embodiment of the present invention.

FIG. 4 represents a dosing head 400 that is similar to dosing head 106 (FIG. 1). A dosing head body 402 contains a vacuum for insulation and receives a feed conduit 404 from one side. A vacuum-insulating jacket for the conduit 404 is not shown. A valve body 406 receives a needle valve 408 that operates up and down against a valve seat 410. A pneumatic or electric type actuator 412 at the top operates the normally closed needle valve 408. A supply chamber 414 is flooded with liquid nitrogen during operation. Such inundates the seating area of the needle valve 408. Any unused liquid nitrogen, or nitrogen that has turned to gas, is circulated past into a return chamber 416 and out back up to the reservoir through a dual pair of return lines 418 and 420. The feed conduit 404 and the return lines 418 and 420 are routed back to the reservoir through the one vacuum-insulating jacket. It is critical to the present invention that all such conduits, lines, and jackets be flexible so that the position and tilt of the dosing head 400 can be adjusted in the field without changing the position or attitude of the liquid nitrogen reservoir. A metering orifice 422 is screwed into the valve body 406 down past the needle valve 408 and seat 410. This position allows the metering orifice 422 to be serviced from an opening inside a heated nozzle collar 424 and without having to drain the system first. A metal bellows 426 provides a long thermal path that helps separate any heat in the nozzle collar 424 from the liquid nitrogen inside the valve body 406. A nozzle 428 provides a passageway for droplets of liquid nitrogen to squirt out under pressure when the needle valve 408 is operated. A purge chamber 430 is kept filled with gaseous nitrogen to prevent a build-up of ice crystals that could clog the nozzle 428 and the metering orifice 422.

Figure 5:
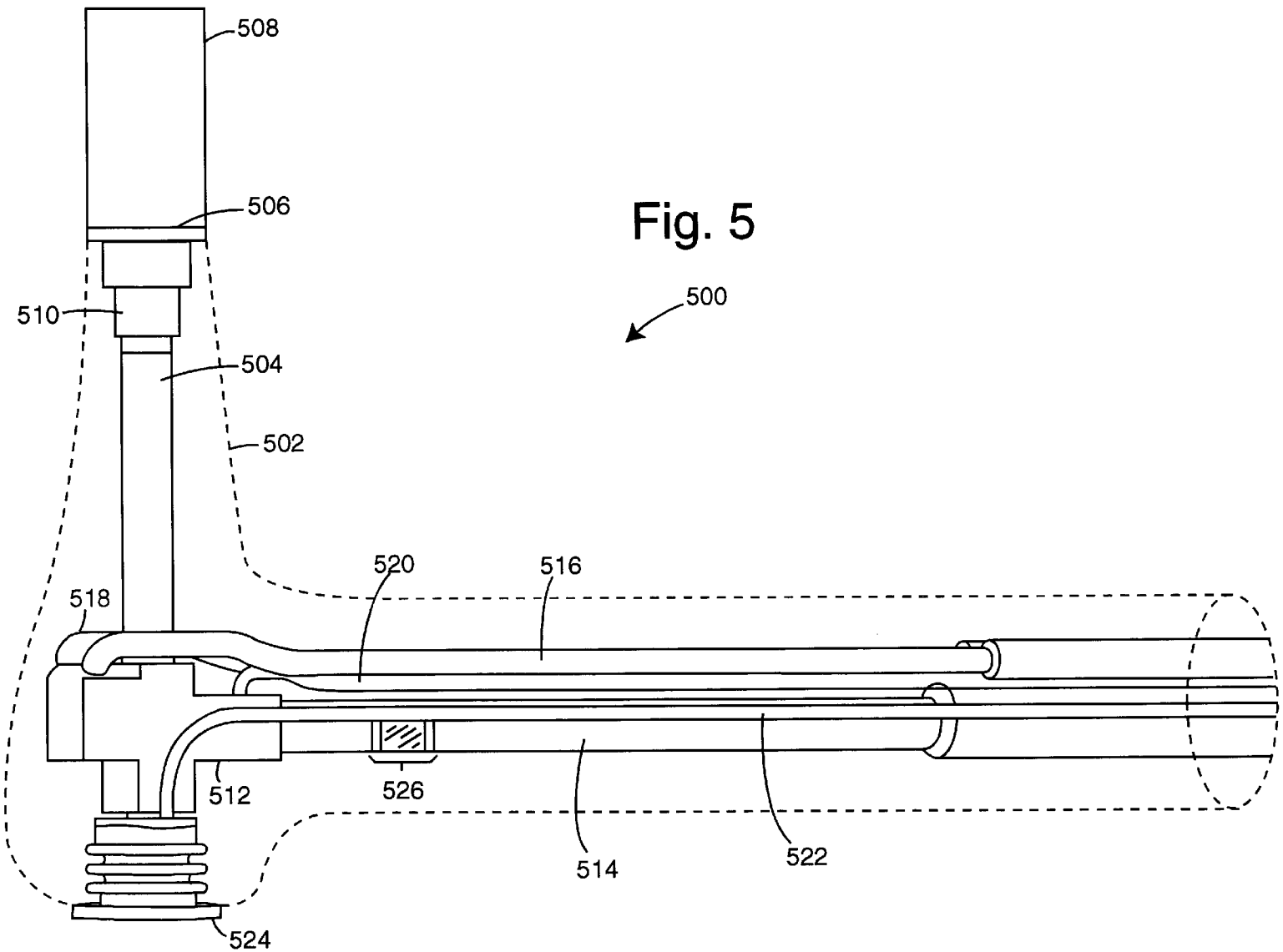
FIG. 5 is a diagram of a valve body, valve actuator, dosing head, and extension arm embodiment of the present invention with the vacuum-insulation jacketing shown in phantom.

FIG. 5 represents a dosing arm 500 that is similar to dosing head 106 (FIG. 1) and dosing head 400 (FIG. 4). A vacuum insulating covering 502 is shown only in phantom so that the internal parts may be described here. A valve stem tube 504 supports a threaded bushing 506 and a valve actuator 508. A valve stem seal 510 separates the actuator 508 from any nitrogen that is supplied to a valve body 512. A large liquid-nitrogen feed conduit 514 supplies a constant circulating flow of phase-separated liquid nitrogen. A pair of smaller dual return lines 516 and 518 provide the return path for such circulation. A pressure tap 520 connects to a port 312 (FIG. 3) and allows a pressure gauge to be fitted so that the user can see how much hydraulic pressure head exists inside the valve body 512. A purge gas line 522 feeds gaseous nitrogen to keep a nozzle 524, and also area 430 (FIG. 4), free of ice crystals. For example, a purge gas flow rate of three to five standard cubic feet per hour (SCFH) has been found acceptable. A sight glass 526 is brazed in-line with the liquid-nitrogen feed conduit 514 in some dosing arms 500 so that a user could see if any liquid nitrogen was actually flowing. Such site glass 526 was particularly useful during the development of various embodiments of the present invention.

The pair of smaller dual return lines 516 and 518 coming from two taps on opposite sides of the top of valve body 512 critically provide an ability for the whole dosing arm 500 to be tilted ± 60 degrees from normal relative to a moving assembly line of containers or bottles receiving a droplet of liquid nitrogen. Such adjustable tilting allows more reliable dosing, especially when the assembly line is moving very fast or the product in the container is likely to splash back at the nozzle opening and create blockages. In operation with the dosing arm 500 tilted, one or the other dual return lines 516 and 518 will be near zenith relative to the nozzle 524, and that one will be best able to collect and draw off gaseous nitrogen.

Figure 6:
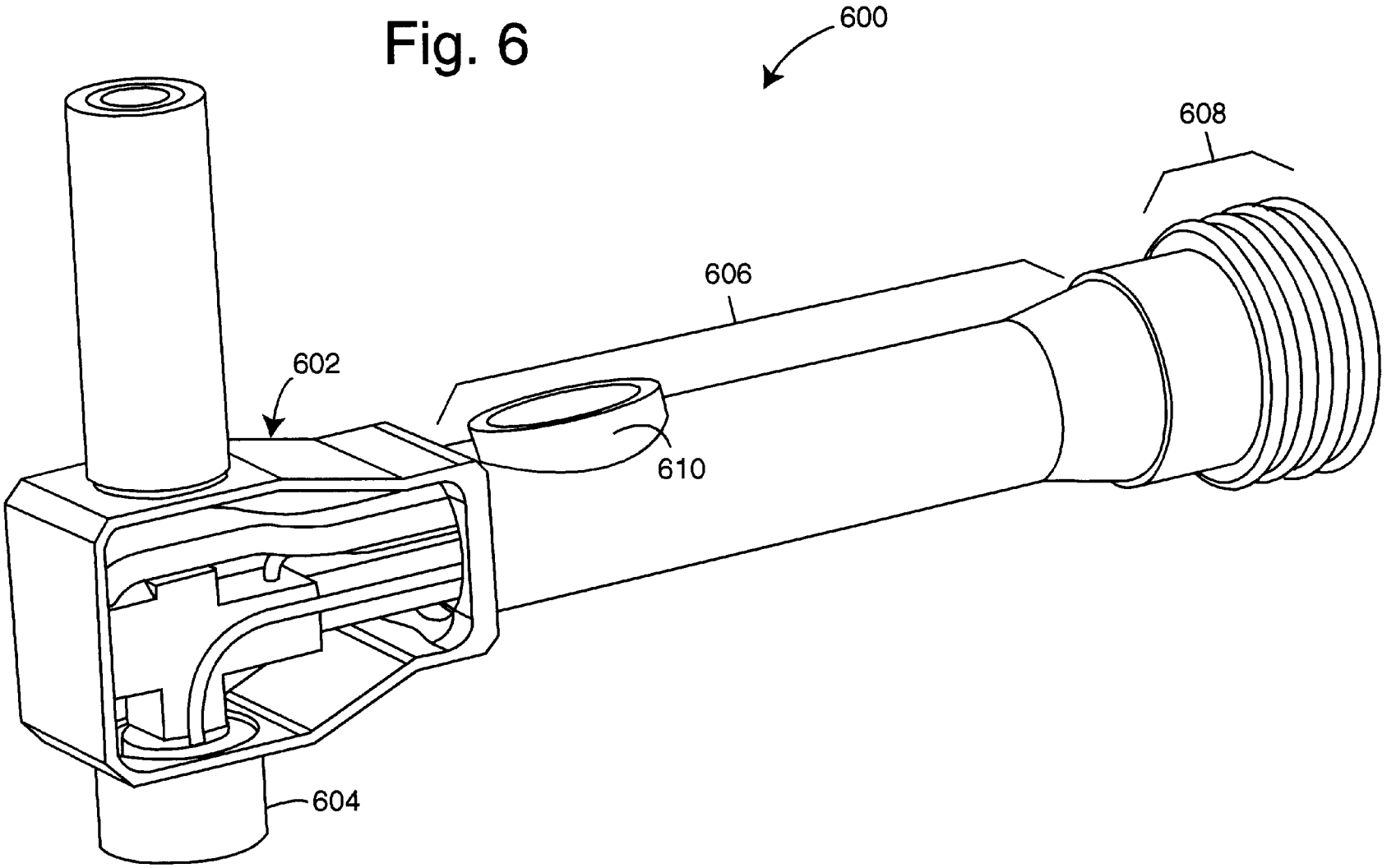
FIG. 6 is a perspective diagram of a dosing arm embodiment of the present invention with a weld cap on the side of the dosing head removed so the valve body and some of the internal plumbing can be seen.

FIG. 6 represents a dosing arm 600 that is similar to dosing head 106 (FIG. 1), dosing head 400 (FIG. 4), and dosing arm 500 (FIG. 5). A valve housing 602 includes a vacuum for thermal insulation and has a dosing outlet 604 shown without it's heater. A rigid section 606 connected to a flexible conduit 608. Both also contain the vacuum insulation necessary. One of the present inventors, Alex Ziegler, described the construction of a similar flexible conduit in U.S. patent application Ser. No. 09/150,511, filed Sep. 9/1998, and incorporated herein by reference. A window 610 allows the sight glass 526 (FIG. 5) to be seen during operation.

It is critical to embodiments of the present invention that the dosing arm 600 have a width no greater than 1.65 inches and a height of nine inches, in order to be able to retrofit into the existing applications the present inventors have repeatedly encountered. This is necessary for applications where a liquid nitrogen injection system must be squeezed into very tight openings in the spaces just above a fast moving production line. The reservoir associated with it is then placed above and to either side of the production line wherever the space allows and is likely to be available. Being able to place the injection system on either side of the production line and not having to predetermine this prior to the installation of the system is important.

Figure 7:
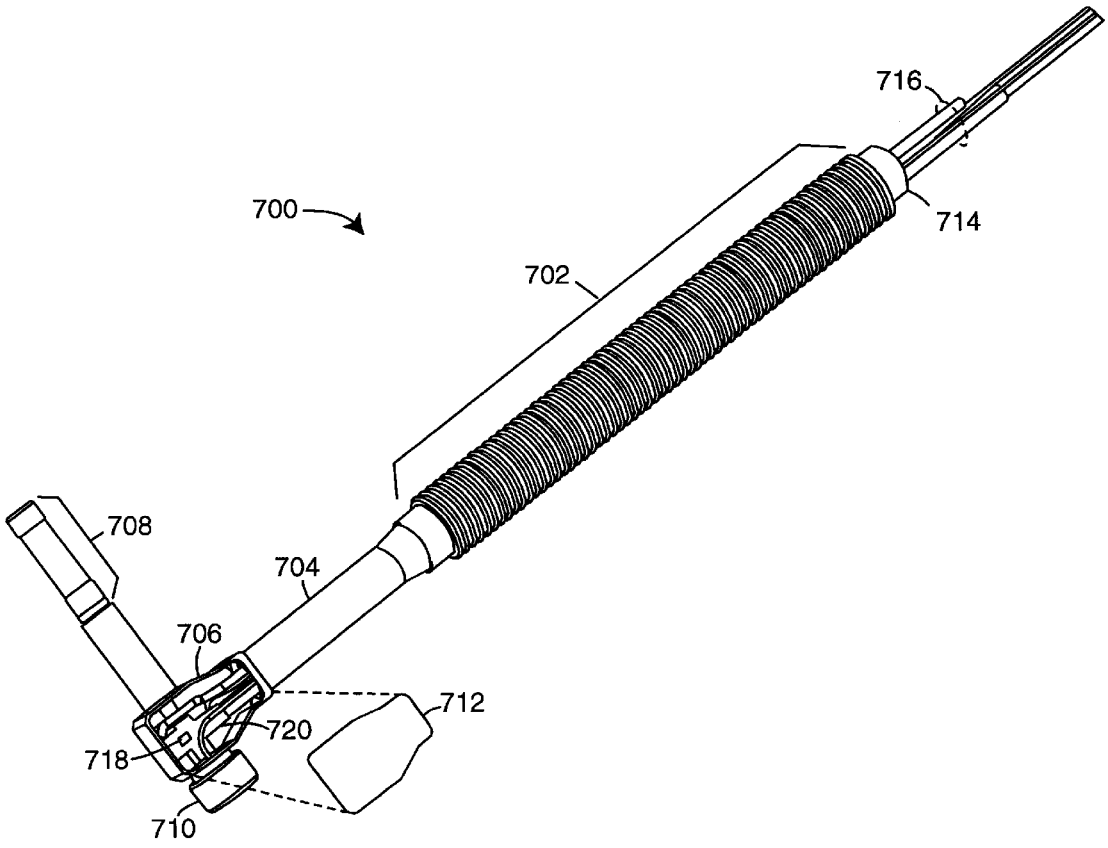
FIG. 7 is a perspective diagram of a complete dosing arm embodiment of the present invention showing how a weld cap fits onto the side of the dosing head.

FIG. 7 shows another dosing arm 700 and a full-length arm 702. An extension 704 connects the arm 702 to a dosing head 706. A typical extension 704 is one-and-half inches in diameter and formed of stainless steel. The arm 702 itself is about two feet long and the outer vacuum containment jacket is a bellows type 0.012 inch wall 321-SS tubing about 2.5" diameter that can resist collapsing under the vacuum within. An actuator 708 operates a dosing valve within the dosing head 706. A nozzle area 710 is provided with an internal integral nitrogen gas purge and an electric heater to prevent freeze up. A cover 712 is welded onto the side of the dosing head 706 and completes the vacuum seal. One end 714 of the bellows jacket of the arm 702 is coupled into the vacuum-insulation envelope system of a vacuum insulated liquid nitrogen reservoir. A group of feed, return, purge, and pressure tap conduits 716 also connect into the reservoir system. A resistive-type electric heater 718 is attached to the side of a valve body 720 and provides about forty watts of heat from a 24-volt DC source. Such heater 718 is operated only during servicing procedures.

Figure 8:
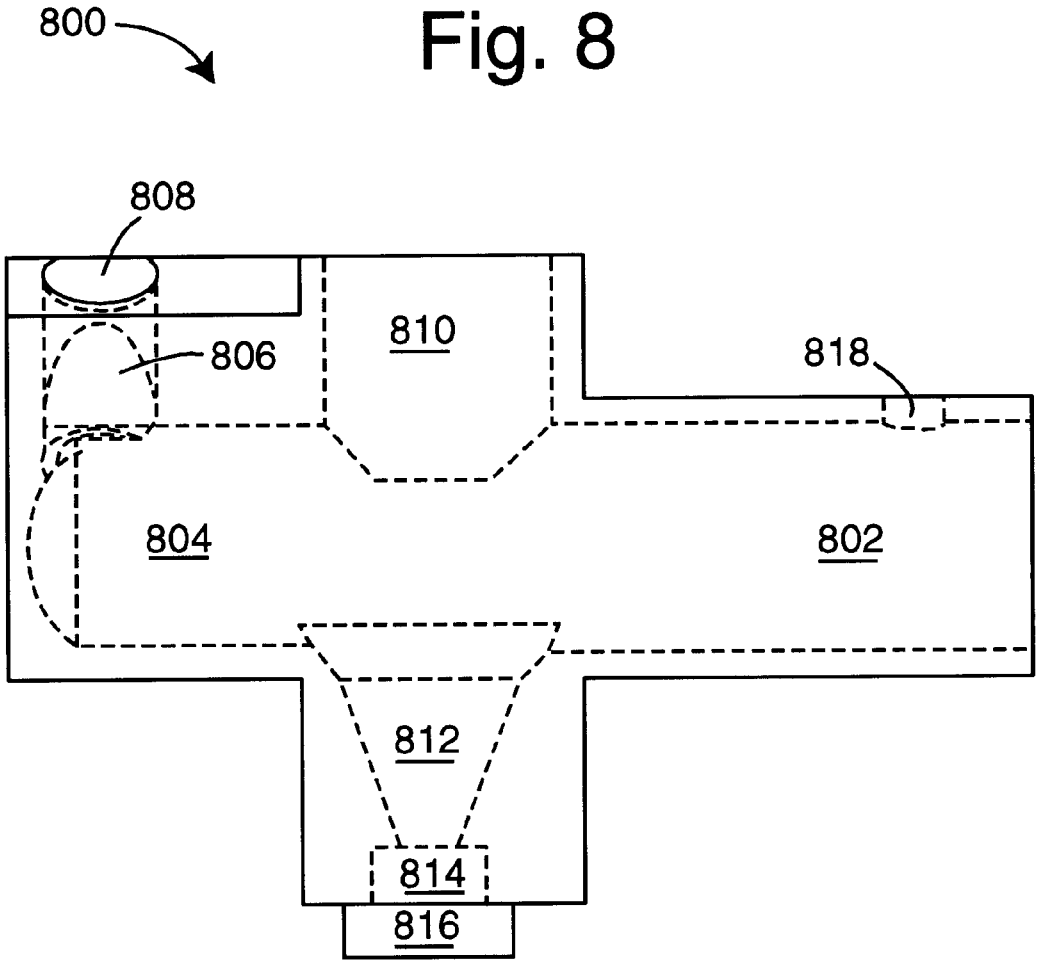
FIG. 8 is a side view cross sectional diagram of a valve body embodiment of the present invention.

FIG. 8 details the machining and construction of a stainless steel valve body 800 which is similar to valve body 406 (FIG. 4). A round feed chamber 802 has an outside block dimension of 0.75 inches square, and continues down into a return chamber 804. A pair of return channels and return ports are represent by channel 806 and port 808. A needle valve bore 810 of about 0.50 inches inside diameter is coaxially aligned with a conical needle seat area 812 with a base of about 0.40 inches diameter. A valve outlet area 814 of about 0.25 inches inside diameter is met with a threaded hole 816 for a metering orifice. A hole tap 818 provides a connection port for a pressure gauge.

Figure 9:
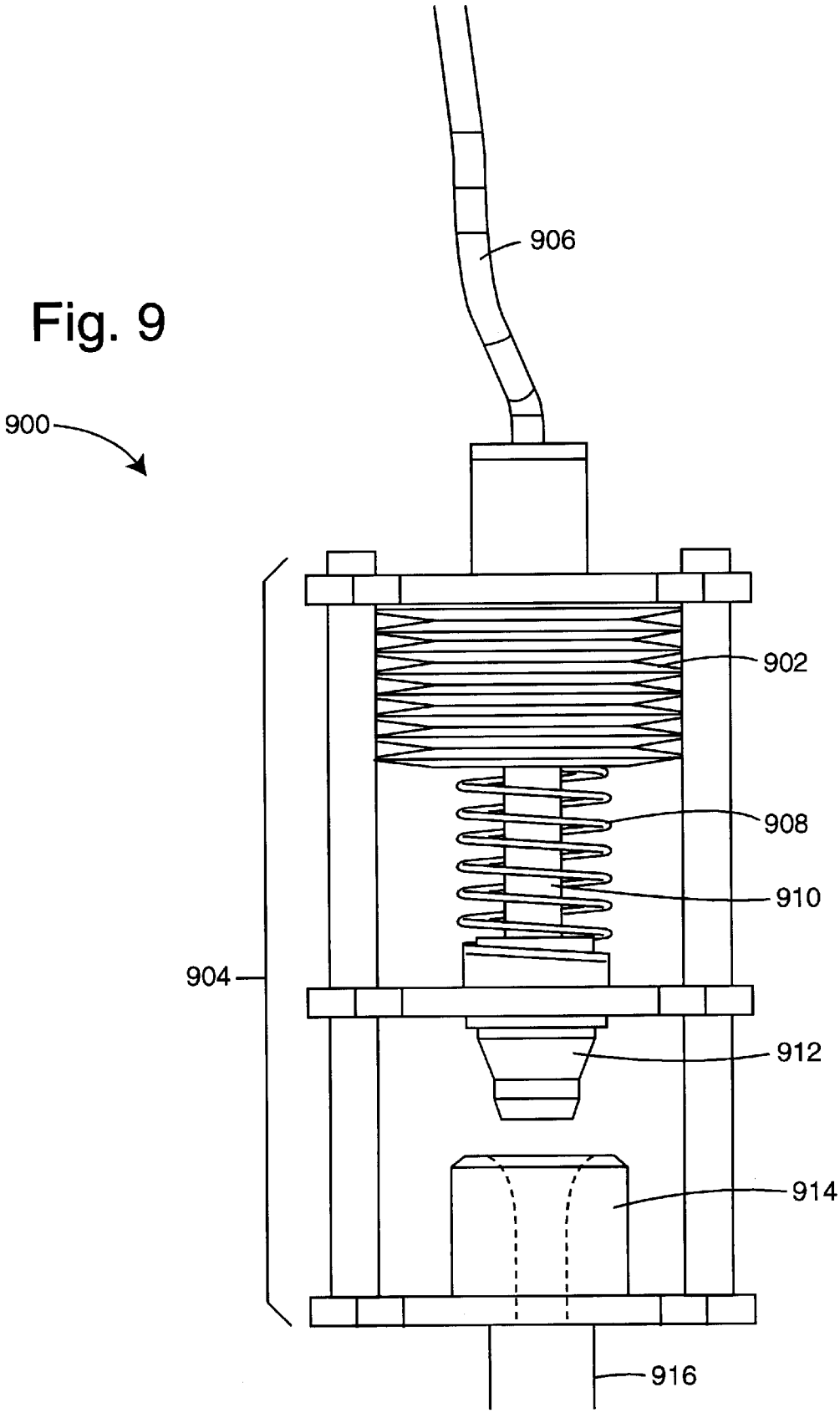
FIG. 9 is a side view diagram of a bellows valve assembly embodiment of the present invention.

FIG. 9 is a bellows-controlled feed valve assembly 900 that can be used to shut-off the supply of liquid nitrogen to a dosing arm, such as dosing arm 700 (FIG. 7). A stainless steel thin-wall bellows 902 is attached at a top end to a frame 904. When pneumatic pressure is received on a pneumatic tube 906, a gas flows into the bellows 902 and it expands downward and pushes against a spring 908. Such gas may have to be one that boils at a temperature much lower than the temperature of the liquid nitrogen surrounding the bellows 902, e.g., helium.

A stem 910 is connected between the bottom of the bellows 902 and a valve needle 912. When the pneumatic pressure on pneumatic tube 906 is sufficiently strong, the bellows 902 will expand far enough to push the valve needle 912 all the way into a valve seat 914. Since any liquid nitrogen that flows out into a feed conduit 916 must drain out through the valve seat 914, such pneumatic pressure will close-off the supply of liquid nitrogen as long as the pneumatic pressure is maintained.

Figure 10:
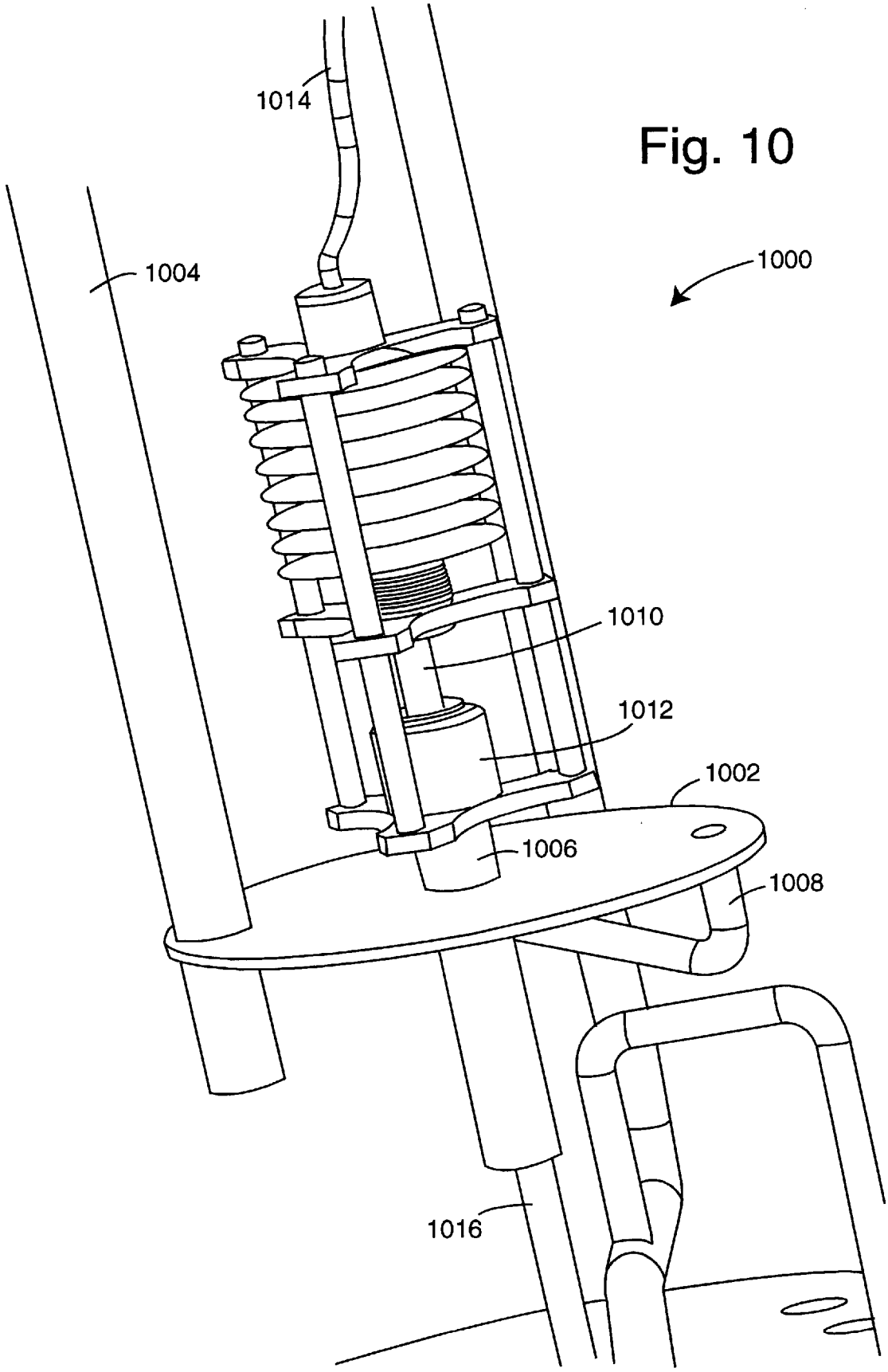
FIG. 10 is a side view diagram of a bellows valve assembly, similar to that in FIG. 9, being used in a liquid nitrogen reservoir embodiment of the present invention like that of FIG. 2.

FIG. 10 shows the application and placement of a bellows-controlled feed valve assembly 1000 like the assembly 900 (FIG. 9) inside a liquid nitrogen reservoir. A bottom disc 1002 is equivalent to bottom disc 208 (FIG. 2). A return stack 1004 is similar to return stack 220 (FIG. 2). The bellows-controlled feed valve assembly 1000 is fitted on top of a feed outlet 1006 that functions the same as feed outlet 222 (FIG. 2). A drain 1008 is also the same as drain 224 (FIG. 2). The bellows-controlled feed valve assembly 1000 is shown in FIG. 10 in its fully activated position, so a needle valve 1010 is shown fully seated in a valve seat 1012. When the pneumatic pressure on a feed valve pneumatic control tube 1014 is relaxed, the liquid nitrogen inside the reservoir will be able to flow out through a feed conduit 1016. Therefore, the valve is a normally open type. The control tube 1014 can be conveniently routed to the outside through the atmospheric vent.

Figure 11:
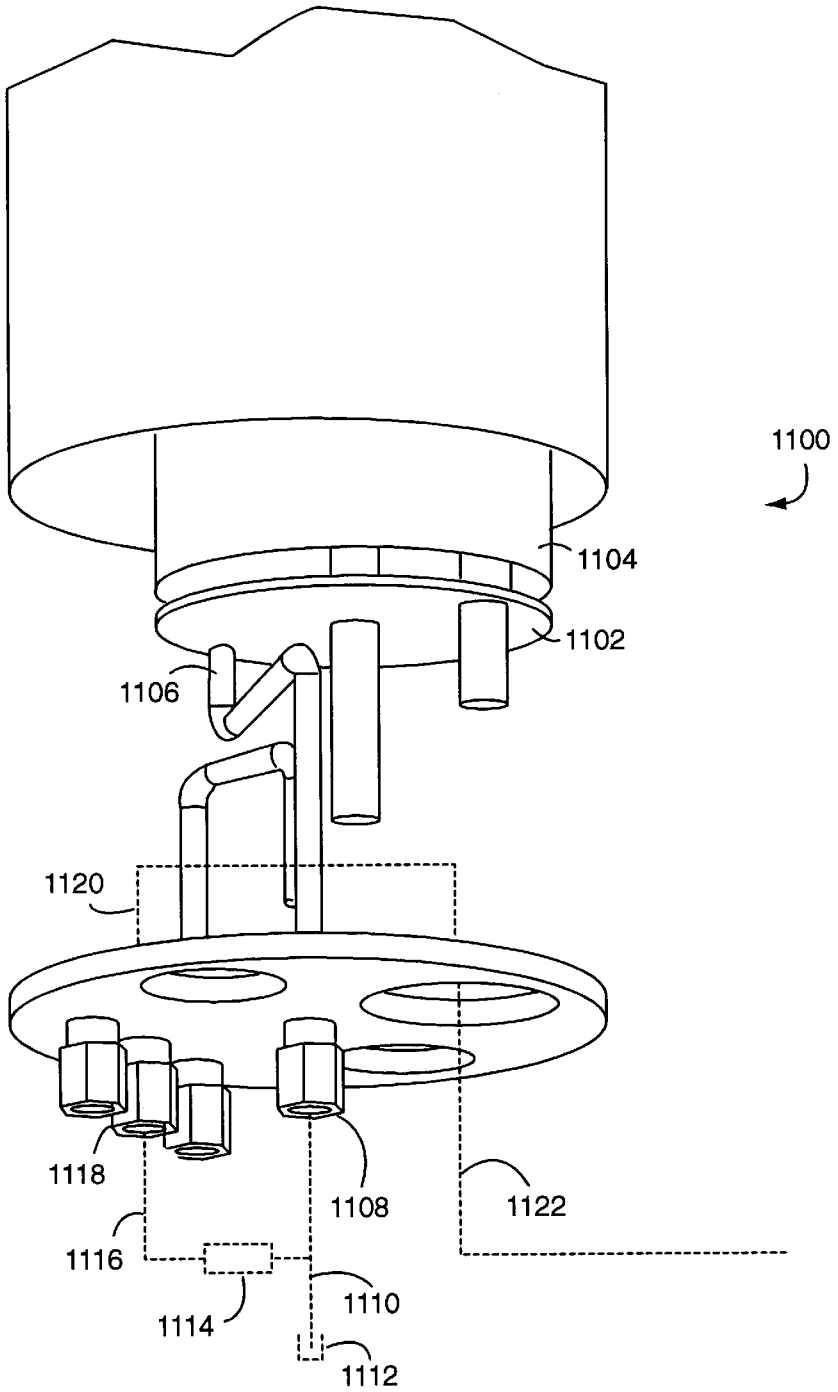
FIG. 11 is a perspective diagram showing the plumbing details of the drain and feed conduit connections to the bottom of the liquid nitrogen reservoir.

FIG. 11 shows a purge gas source assembly 1100. A bottom plate 1102 for a liquid nitrogen cylinder 1104 has a drain line 1106 connected to it which runs out through a bottom drain fitting 1108. A drain pipe 1110 is normally fitted with a cap 1112. When such cap is not removed and the cylinder 1104 has some liquid nitrogen in it, a flow will proceed through a fixed sintered orifice (snubber) 1114 back up a pipe 1116 to another bottom fitting 1118. This connects to a pipe trap section 1120 which supplies a purge conduit 1122 like purge gas line 522 (FIG. 5). The liquid nitrogen is forced to pass through the small snubber 1114 and this reduces the flow rate. The combination of the long run and small diameter of purge conduit 1122 speed the vaporization of the liquid nitrogen, and so purge gas source assembly 1100 is an effective and reliable source, e.g., to keep nozzle 524, and area 430 (FIG. 4), free of ice crystals In preferred embodiments of the present invention, the reservoir and arm may be positioned on either side of a production container line and the whole rotated as required before flexing the arm so the dosing valve will be positioned with the correct tilt angle for particular production environments.

Although the present invention has been described in terms of the presently preferred embodiments, it is to be understood that this disclosure should not be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A flexible extension arm, comprising:

a vacuum-insulated feed conduit for circulating a flow of liquid nitrogen from a reservoir to a control valve in a dosing head; and a pair of vacuum-insulated return conduits for circulating said flow of liquid nitrogen back from said control valve in said dosing head;

wherein, a system for injecting liquid nitrogen into food and beverage packages on a high speed production line just before environmental sealing is provided.

2. The flexible extension arm of claim 1, wherein:

the vacuum-insulated feed and return conduits allow for a rotational tilting of said control valve and dosing head to better inject a dose of liquid nitrogen from said control valve into a moving container.

3. The flexible extension arm of claim 1, further comprising:

a purge gas line that conveys gaseous nitrogen from a tap on said reservoir to a nozzle in said dosing head;

wherein, said gaseous nitrogen purges air from said nozzle and reduces clogging due to water vapor in the atmosphere freezing.

4. The flexible extension arm of claim 1, further comprising:

a sight-glass placed in-line with the vacuum-insulated feed conduit and viewable by a user;

wherein, any flow of liquid nitrogen through the vacuum-insulated feed conduit during operation may be observed by said user.

5. A liquid-nitrogen dosing head for injecting metered droplets of liquid nitrogen into a product moving along a packaging assembly line, comprising:

a valve body including an input chamber, an output chamber and an injection valve in between;

a single feed port disposed in a near end of the valve body for receiving a circulating liquid nitrogen flow from a vacuum-insulated liquid-nitrogen reservoir into said input chamber; and a pair of return ports disposed in a distal end near the top of the valve body for returning said circulating liquid nitrogen flow from said output chamber to said vacuum-insulated liquid-nitrogen reservoir;

wherein, during operation any circulating liquid nitrogen flow that is not passed out through said injection valve toward a food product on a production line is returned through at least one of the pair of return ports.

6. The liquid-nitrogen dosing head of claim 5, wherein:

the pair of return ports provide for at least one return port to be nearer zenith at a particular forward-backward tilt of the valve body relative to a line of movement of said product on said production line.

7. The liquid-nitrogen dosing head of claim 5, further comprising:

a metering orifice placed downstream and independent of said injection valve, and for providing an adjustment of the volume of said liquid nitrogen that can pass into said product during operation.

8. The liquid-nitrogen dosing head of claim 7, wherein:

the metering orifice is replaceable and said injection valve is normally closed to permit a replacement of the metering orifice without necessitating the valve body to be first drained of liquid nitrogen.

9. The liquid-nitrogen dosing head of claim 5, further comprising:

an electrical heater in thermal contact with the valve body and for providing component temperatures compatible with servicing and maintenance procedures involving the dosing head.

10. A system for injecting liquid nitrogen into a container on a high speed production line just before environmental sealing, comprising:

a vacuum-insulated liquid-nitrogen reservoir for mounting higher in elevation than a moving production packaging assembly line and positioned off to one side;

a dosing head for mounting directly above said moving production packaging line, and including a control valve for injecting metered droplets of liquid nitrogen into a product moving along said production packaging assembly line;

a flexible extension arm with vacuum-insulated feed and return conduits for circulating a flow of liquid nitrogen between the reservoir and said control valve in the dosing head;

a valve body disposed within the dosing head and including a needle valve to control said injecting metered droplets of liquid nitrogen; and a pair of return lines connected to the valve body that circulate liquid nitrogen from the dosing head back to the reservoir;

wherein, the flexible extension arm provides for an elevation adjustment of the vacuum-insulated liquid-nitrogen reservoir relative to the dosing head and adjustment of a dosing liquid pressure.

11. The system of claim 10, wherein:

the valve body includes a pair of return ports on opposite sides of a top that allow at least one of said pair of return lines connected to the valve body to be near zenith and providing for continued circulation of said liquid nitrogen from the dosing head back to the reservoir when the dosing head is tilted relative to said moving packaging assembly line.

* * * * *